US010478040B1

(12) United States Patent
Ford, Jr.

(10) Patent No.: US 10,478,040 B1
(45) Date of Patent: Nov. 19, 2019

(54) HANDLE ASSEMBLY FOR AN APPLIANCE DOOR

(71) Applicant: Haier US Appliance Solutions, Inc., Wilmington, DE (US)

(72) Inventor: Bradley Duane Ford, Jr., Vine Grove, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/104,984

(22) Filed: Aug. 20, 2018

(51) Int. Cl.
*A47L 15/42* (2006.01)
*E05B 1/00* (2006.01)

(52) U.S. Cl.
CPC ..... *A47L 15/4257* (2013.01); *E05B 1/0015* (2013.01); *Y10T 16/458* (2015.01)

(58) Field of Classification Search
CPC ..... Y10T 16/542; A47L 15/4257; A47L 15/4261; A47L 15/4265; A47L 15/4259; E05B 1/0015; F25D 23/028
USPC ..... 16/412; 134/56 D, 200, 57 D, 58 D; 312/405
See application file for complete search history.

(56) References Cited

U.S. PATENT DOCUMENTS

| | | | | |
|---|---|---|---|---|
| 8,810,423 | B2 | 8/2014 | Kaczmarek et al. | |
| 9,005,371 | B2 | 4/2015 | Egger et al. | |
| 9,161,675 | B2 | 10/2015 | Eng et al. | |
| 9,607,489 | B2 | 3/2017 | Roberson et al. | |
| 2003/0168080 | A1* | 9/2003 | Raches | A47L 15/0049 134/18 |
| 2011/0192430 | A1* | 8/2011 | Baldwin | A47L 15/4257 134/137 |
| 2011/0247276 | A1* | 10/2011 | Egger | A47L 15/4257 49/460 |
| 2017/0096837 | A1* | 4/2017 | Criner | A47L 15/4257 |
| 2018/0135333 | A1* | 5/2018 | Viswanathan | E05B 1/0084 |
| 2019/0059693 | A1* | 2/2019 | Kendall | A47L 15/4261 |

FOREIGN PATENT DOCUMENTS

| | | | | |
|---|---|---|---|---|
| CA | 2793674 | C | 12/2016 | |
| DE | 3211528 | A1 * | 10/1982 | H05B 6/763 |
| DE | 102010028414 | A1 * | 11/2011 | E05B 1/0015 |
| WO | WO2014101930 | A1 | 7/2014 | |

* cited by examiner

*Primary Examiner* — William L Miller
(74) *Attorney, Agent, or Firm* — Dority & Manning, P.A.

(57) ABSTRACT

A handle assembly for an appliance door includes a handle frame mounted over a handle aperture defined in an outer door. The handle frame defines a pocket recess positioned within a door gap and being configured for receiving a separately manufactured pocket handle. Specifically, the pocket handle includes a horizontal arm extending from a rear of the pocket recess toward a front of appliance door substantially along a horizontal direction and a grip extending from the horizontal arm substantially along a vertical direction.

18 Claims, 10 Drawing Sheets

HANDLE ASSEMBLY FOR AN APPLIANCE DOOR

FIELD OF THE INVENTION

The present disclosure relates generally to appliance doors, and more particularly to handle assemblies mounted within doors of appliances.

BACKGROUND OF THE INVENTION

Appliances frequently include doors for closing, insulating, concealing, or otherwise providing selective access to cavities or chambers of the appliance. These doors typically include an inner door and an outer door that are separated by an air gap which may be filled with fiberglass or insulating foam, e.g., for thermal insulation, sound dampening, etc. In order to permit a user to open and close the appliance door, appliances further include a handle assembly mounted to an outer surface of the appliance door.

However, conventional handle assemblies for appliance doors are injection molded from a single piece of plastic. Specifically, the handle frame and the pocket handle are injection molded as a single piece. Notably, manufacturing limitations related to injection molding may result in reduced thickness and stiffness of the pocket handle in such constructions, which can allow the handle to deflect when the customer opens the door. In addition, to cover a hole in the handle frame formed during manufacturing, these handle assemblies typically include a rigid bracket or cover that is installed on the back of the pocket handle and connects to the grip. However this results in noticeable interface or a seam that is visible to a user. In addition, this interface may be felt by a user when their fingers touched the back surface of the pocket handle.

Accordingly, a door assembly including an improved handle assembly would be desirable. More specifically, a handle assembly for an appliance door that provides improved rigidity, customer feel, and appearance would be particularly beneficial.

BRIEF DESCRIPTION OF THE INVENTION

Aspects and advantages of the invention will be set forth in part in the following description, may be apparent from the description, or may be learned through practice of the invention.

In accordance with one exemplary embodiment of the present disclosure, a handle assembly for an appliance door is provided. The appliance door includes an outer door and an inner door spaced apart by a door gap, the outer door defining a handle aperture. The handle assembly includes a handle frame mounted to the outer door over the handle aperture, the handle frame defining a pocket recess positioned within the door gap and a pocket handle is mounted to the handle frame within the pocket recess. The pocket handle includes a horizontal arm extending from a rear of the pocket recess toward a front of appliance door substantially along a horizontal direction and a grip extending from the horizontal arm substantially along a vertical direction.

In accordance with another exemplary embodiment of the present disclosure, a method of manufacturing a handle assembly for an appliance door is provided. The method includes manufacturing a handle frame defining a pocket recess and manufacturing a pocket handle including a horizontal arm and a grip extending from the horizontal arm. The method further includes assembling the pocket handle and the handle frame such that the horizontal arm extends from a rear of the pocket recess substantially along a horizontal direction and the grip extends from the horizontal arm substantially along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
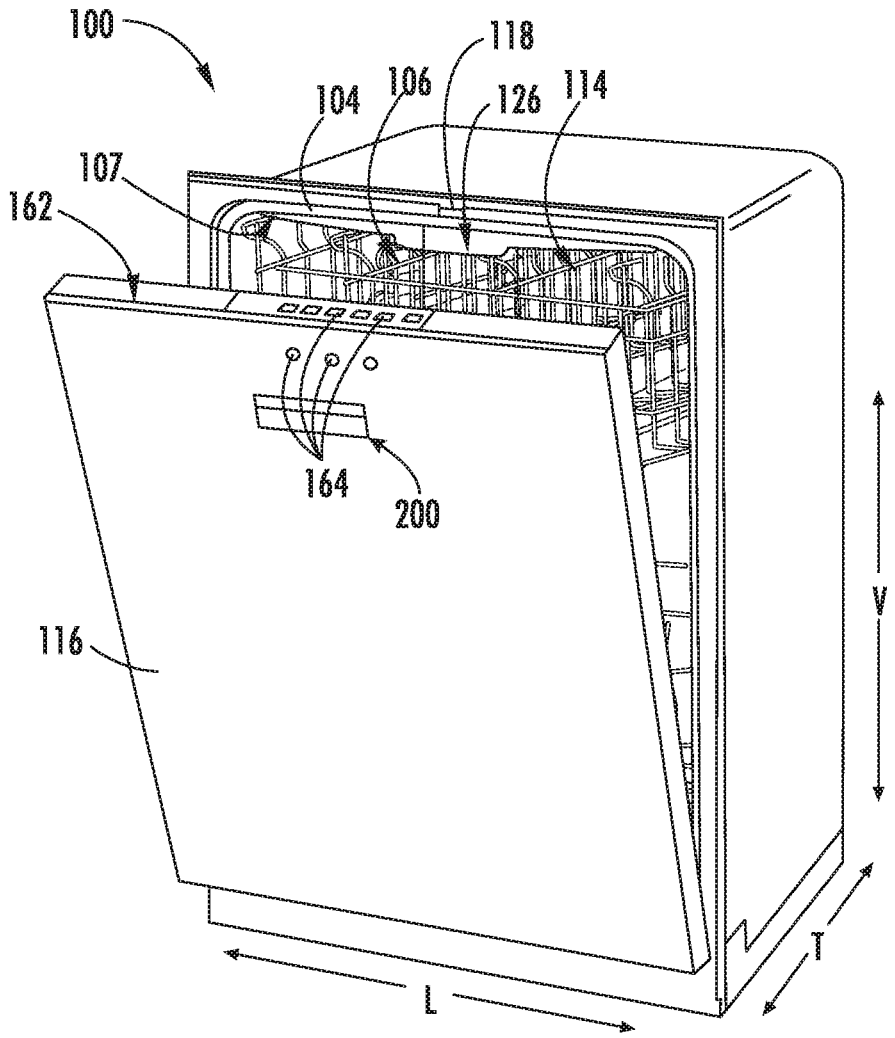
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
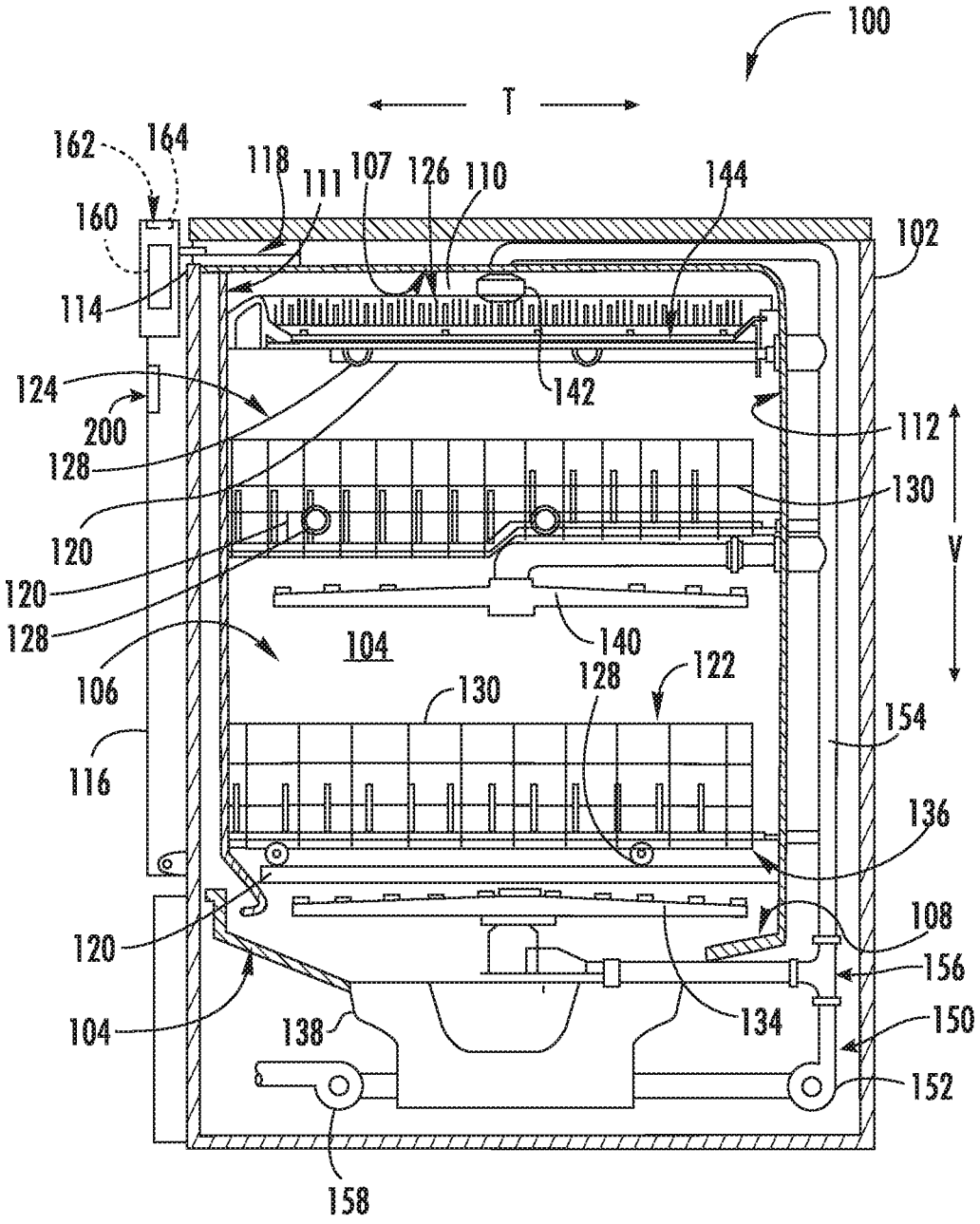
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a circulation pump 152 for circulating water and wash fluid (e.g., detergent, water, and/or rinse aid) in the tub 104. Circulation pump 152 may be located within sump 138 or within a machinery compartment located below sump 138 of tub 104, as generally recognized in the art. Fluid circulation assembly 150 may include one or more fluid conduits or circulation piping for directing water and/or wash fluid from circulation pump 152 to the various spray assemblies and manifolds. For example, as illustrated in FIG. 2, a primary supply conduit 154 may extend from circulation pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, circulation pump 152 draws wash fluid in from sump 138 and pumps it to a diverter assembly 156, e.g., which may include a diverter disk disposed within a diverter chamber (not shown) for selectively distributing the wash fluid to the spray arm assemblies 134, 140, 142 and/or other spray manifolds or devices. For example, the diverter disk may have a plurality of apertures that are configured to align with one or more outlet ports (not shown) at the top of the diverter chamber. In this manner, the diverter disk may be selectively rotated to provide wash fluid to the desired spray device.

According to an exemplary embodiment, diverter assembly 156 is configured for selectively distributing the flow of wash fluid from circulation pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack. Fluid circulation assembly 150 may further include a drain pump 158 for selectively discharging wash fluid within sump 138, e.g., to an external drain.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Figure 3:
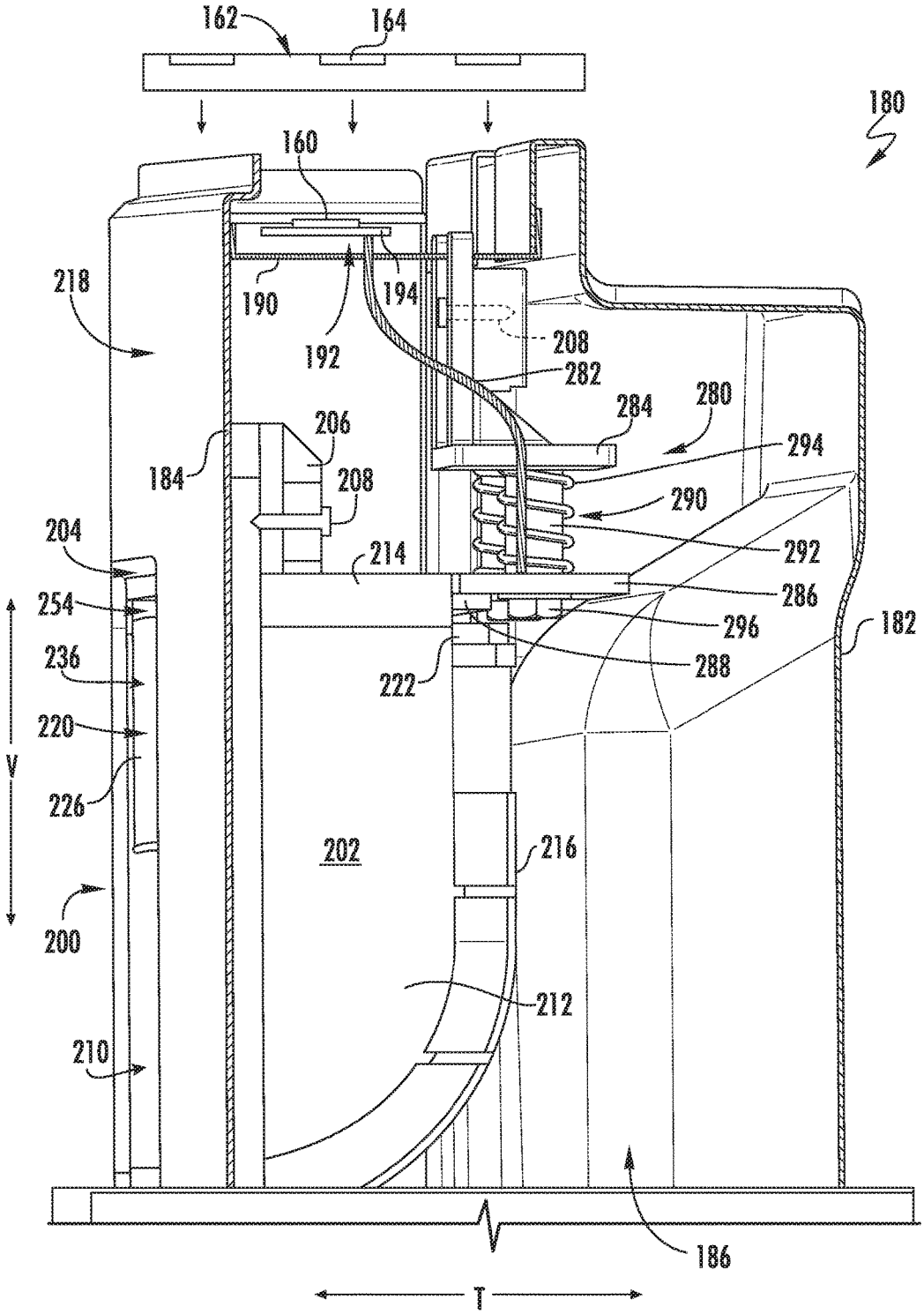
FIG. 3 provides a perspective, cross sectional view of a door assembly of the exemplary dishwashing appliance of FIG. 1 according to an example embodiment of the present subject matter.
Figure 4:
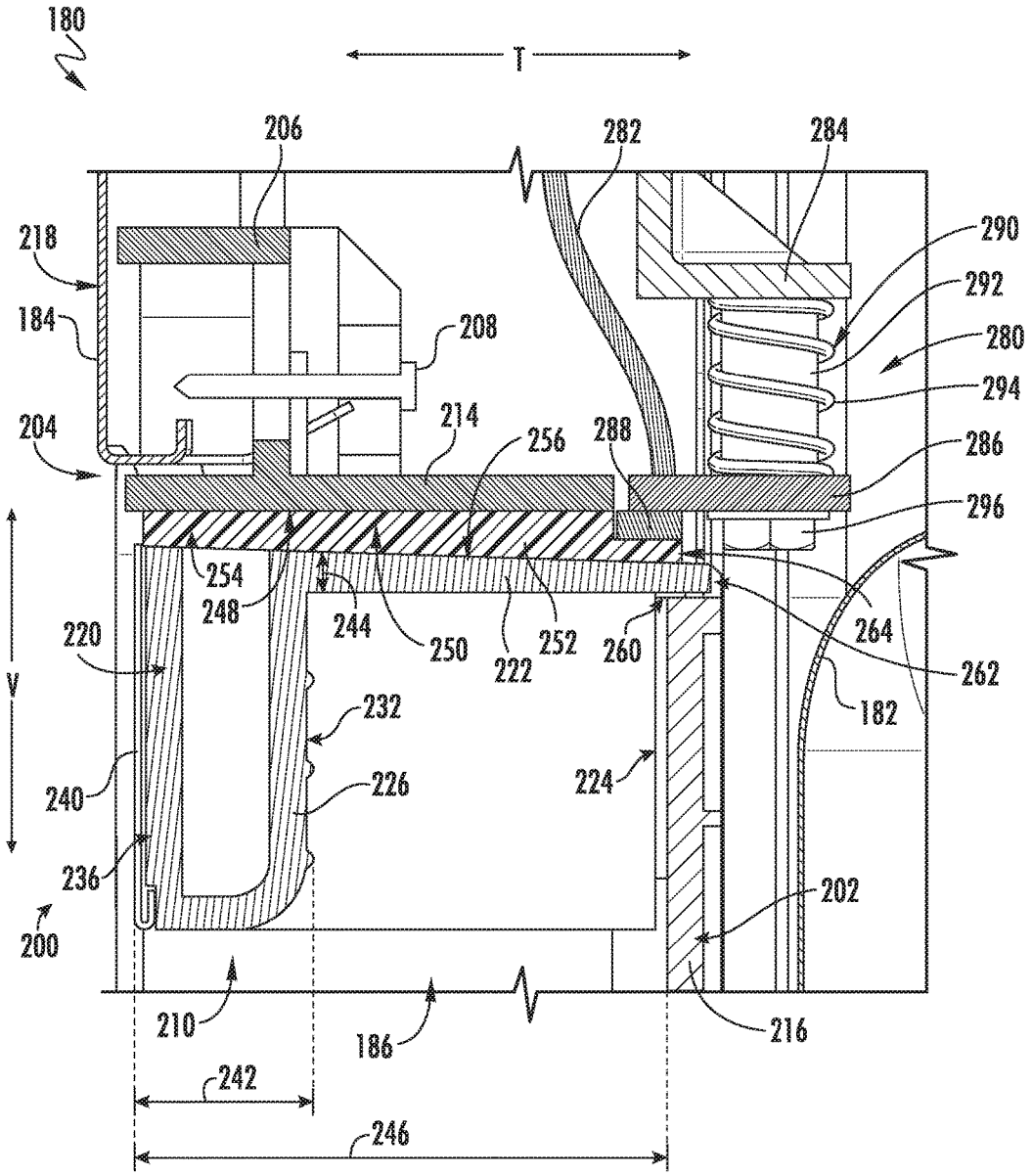
FIG. 4 provides a cross sectional view of a handle assembly of the exemplary door assembly of FIG. 3 according to an example embodiment of the present subject matter.
Figure 5:
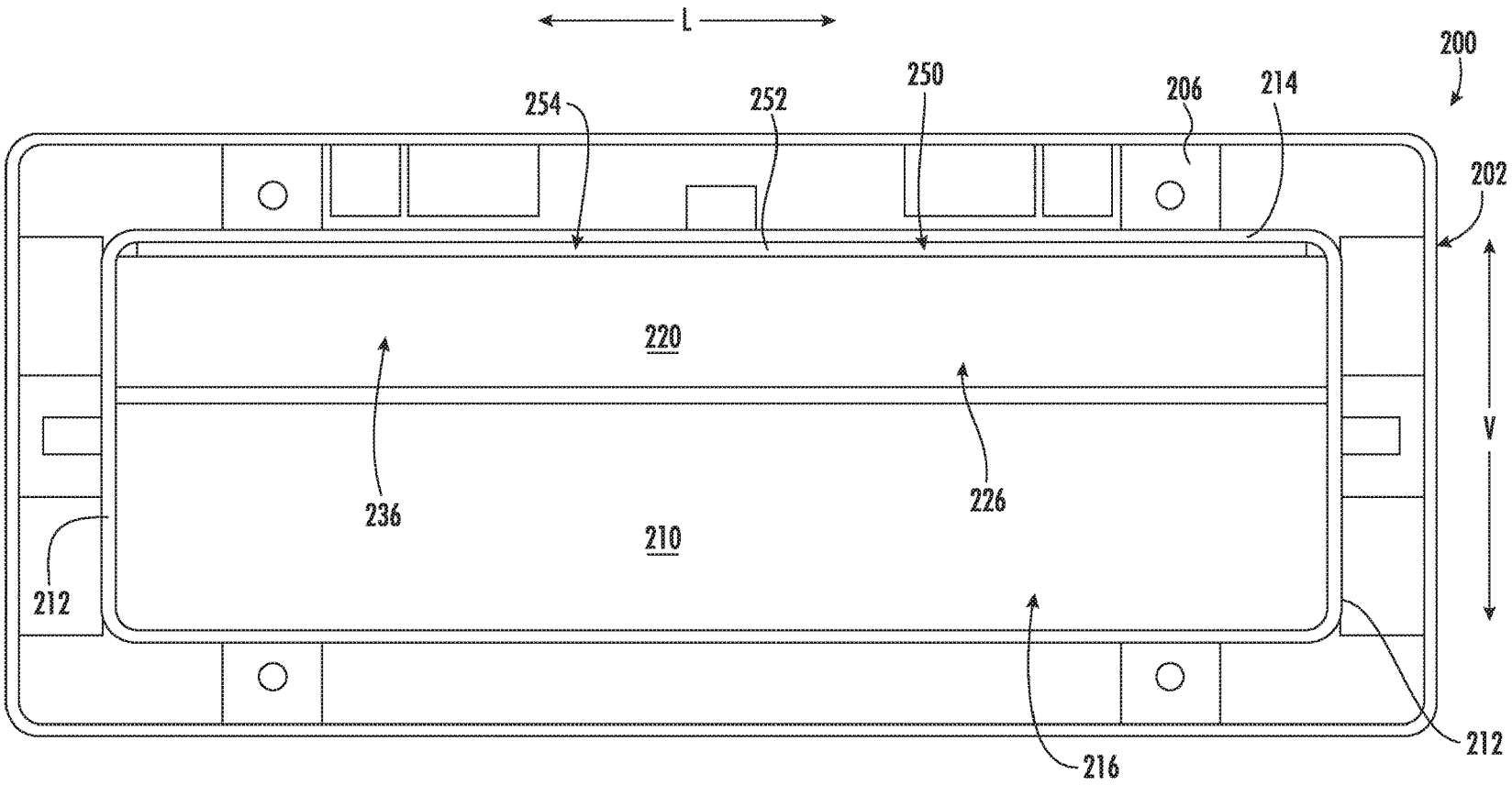
FIG. 5 provides a front view of a handle assembly of the exemplary dishwashing appliance of FIG. 1 according to an example embodiment of the present subject matter.

Referring now generally to FIGS. 3 and 4, a door assembly 180 will be described according to exemplary embodiments of the present subject matter. For example, door assembly 180 may be used as door 116 of dishwashing appliance 100. Alternatively, door assembly 180 may be used on any other suitable residential or commercial appliance. As described herein, door assembly 180 may share a coordinate system with dishwashing appliance 100, e.g., when door assembly 180 is in the closed position (e.g., as shown in FIG. 2). Specifically, door assembly 180 may define a vertical direction V, a lateral direction L, and a transverse direction T. Therefore, these directions will also be used herein to refer to features of door assembly 180 and its various components and sub-assemblies.

As best illustrated, door assembly 180 generally includes an inner door 182 and an outer door 184 which are spaced apart from each other along the transverse direction T to define a door gap 186 therebetween. According to exemplary embodiments, inner door 182 and outer door 184 may be panels that are stamped from stainless steel. Alternatively, inner door 182 and outer door 184 may be formed from any other suitably rigid material, such as thermoformed plastic, other metals, etc.

In general, inner door 182 and outer door 184 may be assembled in any suitable manner. For example, according to the illustrated embodiment inner door 182 and outer door 184 define complementary features that permit outer door 184 to slide onto inner door, e.g., upward along the vertical direction V. After outer door 184 is slid into place, the two doors may be secured using any suitable mechanical fastener, welding, snap-fit mechanisms, etc. In addition, it should be appreciated that an insulating material (not shown), such as fiberglass or foam insulation, may be positioned within door gap 186 to provide thermal and/or sound insulation to dishwashing appliance 100.

Referring now briefly to FIG. 3, door assembly 180 may further include a console bracket 190 which is positioned at a top of door assembly 180 along the vertical direction V. Specifically, console bracket 190 is positioned between and may be used to join inner door 182 and outer door 184. In addition, console bracket 190 may define an electronics compartment 192 which is configured for housing a main control board 194 which is operably coupled to a user interface panel (e.g. such as interface panel 162 of a dishwashing appliance 100).

Referring now to FIGS. 3 and 4, door assembly 180 further includes a handle assembly 200 which is mounted to outer door 184. Specifically, according to the illustrated embodiment, handle assembly 200 includes a handle frame 202 that is fixed within a handle aperture 204 defined within outer door 184. In this regard, handle aperture 204 may be stamped within outer door 184 during fabrication and may be configured for securely receiving handle frame 202.

Specifically, for example, handle frame 202 may define a mounting flange 206 configured for receiving one or more mechanical fasteners 208 (see FIGS. 3 and 4), such that handle frame 202 is mounted over handle aperture 204.

Referring now also to FIGS. 5 through 9, handle assembly 200 will be described in more detail according to an exemplary embodiment of the present subject matter. As illustrated, handle frame 202 generally defines a pocket recess 210 which is positioned within door gap 186. More specifically, handle frame 202 may include two sidewalls 212 spaced apart along the lateral direction L, a top wall 214, and a rear wall 216 which collectively define pocket recess 210. According to the illustrated embodiment, rear wall 216 is curved and extends from a front 218 of door 180 into door gap 186 and upward toward top wall 214.

In addition, handle assembly 200 includes a pocket handle 220 which is fixedly mounted to handle frame 202 within pocket recess 210. In general, pocket handle 220 is the object pulled by a user of dishwasher 100 to open door assembly 180. Therefore, it is desirable that pocket handle 220 and handle assembly 200 be sufficiently rigid and fixed firmly to outer door 184 so that there is no flex, bend, or other distortion of door assembly 180 when a user pulls on pocket handle 220. In addition, it is desirable that handle assembly 200 have a clean appearance with minimal lines, surface ridges, or joints in order to improve user comfort when contacting handle assembly 200. Thus, aspects of the present subject matter are directed to the construction and method of assembling handle assembly 200 within door assembly 180 to provide such rigidity and improved consumer comfort features.

Figure 7:
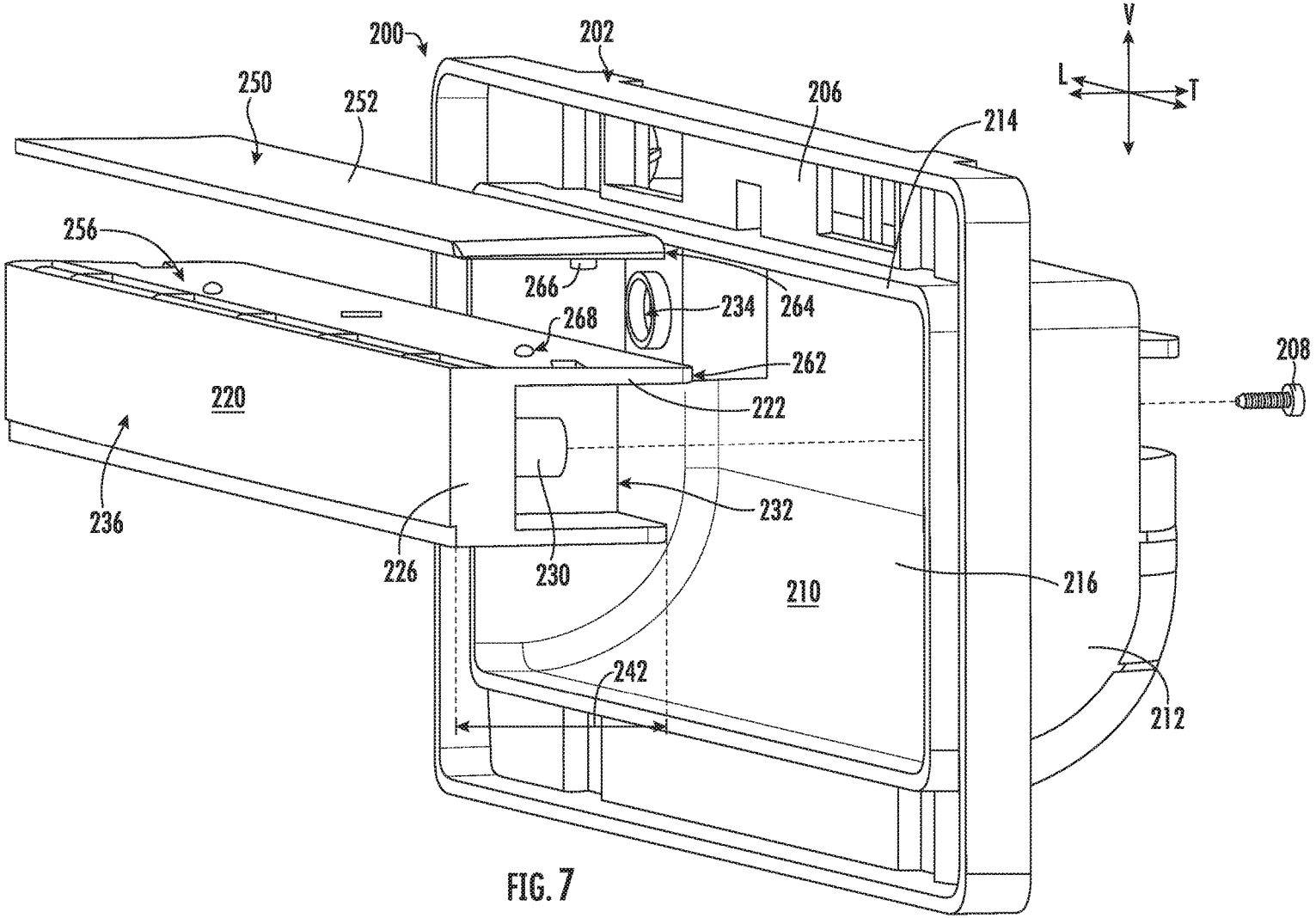
FIG. 7 provides an exploded, perspective view of the exemplary handle assembly of FIG. 5 according to an example embodiment of the present subject matter.
Figure 8:
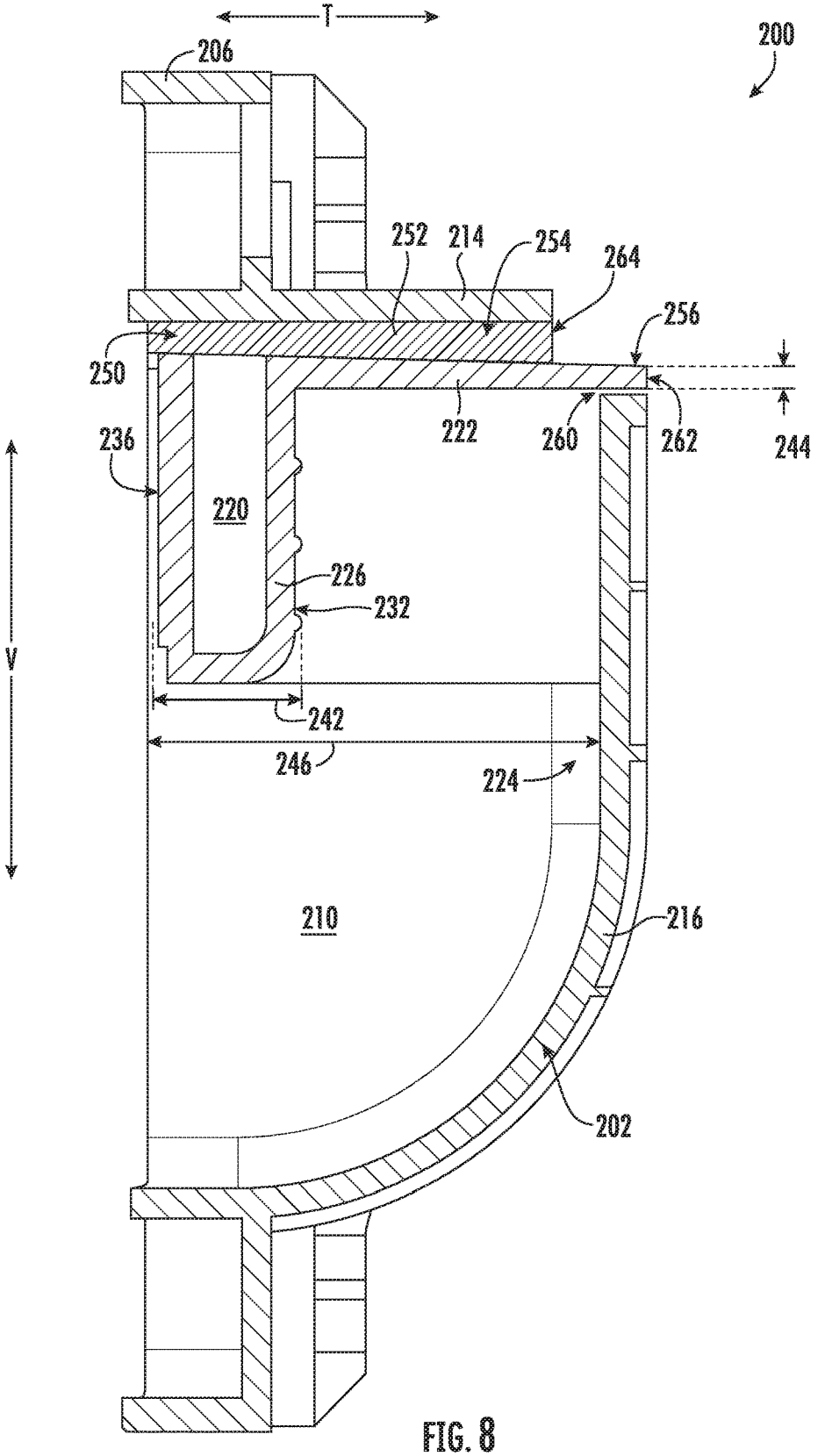
FIG. 8 provides cross sectional view of the exemplary handle assembly of FIG. 5 according to an example embodiment of the present subject matter.
Figure 9:
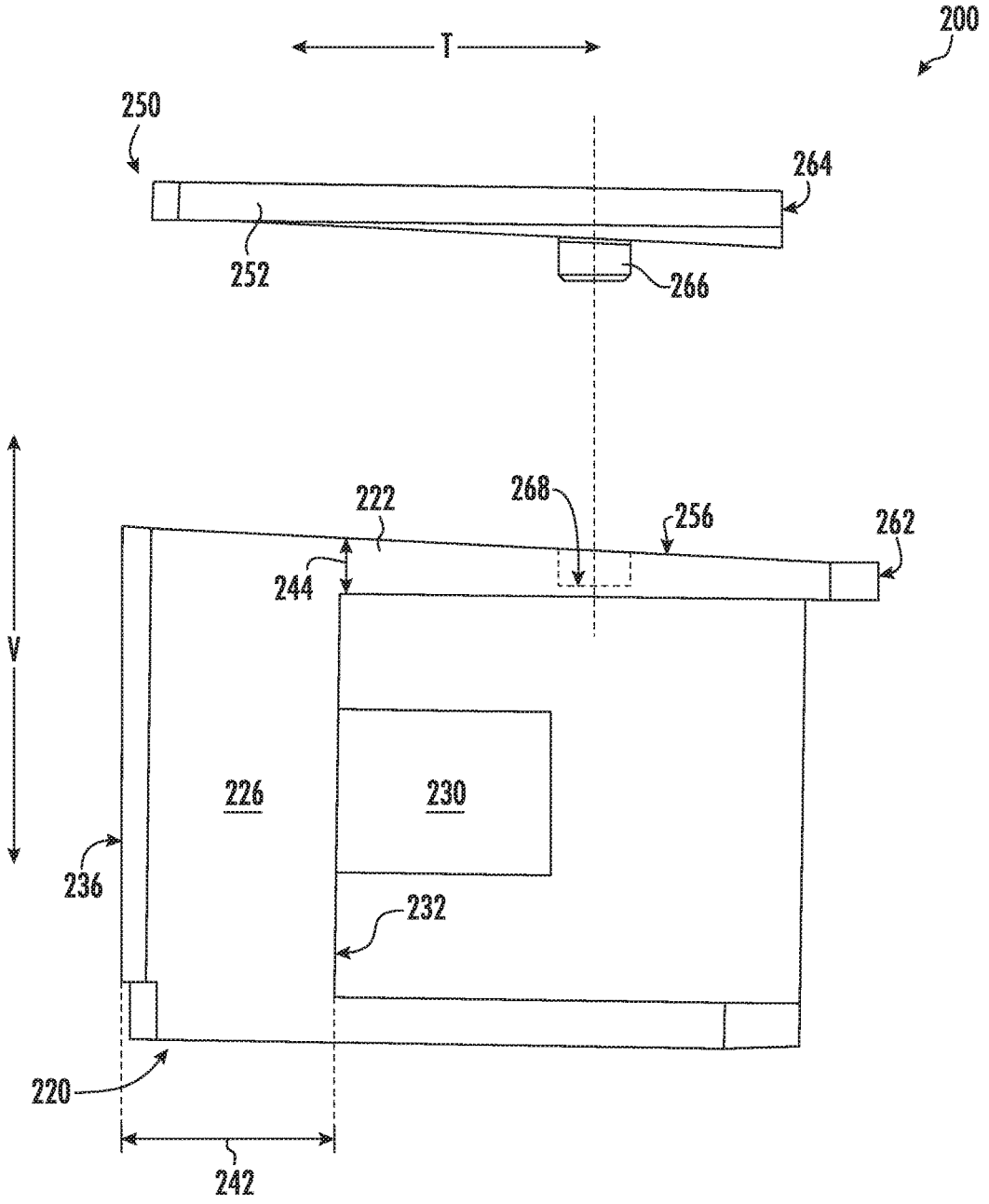
FIG. 9 provides an exploded, side view of the exemplary handle assembly of FIG. 5 according to an example embodiment of the present subject matter.

As best shown in FIGS. 7 through 9, pocket handle 220 includes a horizontal arm 222 that extends from a rear 224 of pocket recess 210 toward front 218 of door assembly 180 substantially along a horizontal direction (e.g. is defined by the lateral direction L and the transverse direction T when door assembly 180 is in the closed position). In addition, pocket handle 220 includes a grip 226 that extends from horizontal arm 222 substantially along a vertical direction V when door assembly 180 is closed.

According to the illustrated embodiment, handle frame 202 and pocket handle 220 are separate parts that are joined together using one or more mechanical fasteners (e.g., such as mechanical fasteners 208, see FIG. 7). Specifically, for example, one or more screw bosses 230 may be defined on a rear side 232 of grip 226 for receiving one or more mechanical fasteners 208 that are passed through holes 234 defined in rear wall 216 of handle frame 202. In this manner, pocket handle 220 may be secured to handle frame 202 using blind mechanical fasteners 208 which are not visible to user and will not be contacted by a user when pulling handle assembly 200.

Notably, when mechanical fasteners 208 pull pocket handle 220 tight against handle frame 202, a front surface 236 of pocket handle 220 may sit flush with front 218 of door assembly 180. Alternatively, as best illustrated in FIG. 4, pocket handle 220 may be further configured for receiving an appearance piece 240 which may, for example, be a similar material, color, and appearance as outer door 184. According such an embodiment, pocket handle 220 may be sized such that an appearance piece 240 sits flush with front 218 of door assembly 180 when handle assembly 200 is installed. It should be appreciated that according to alternative embodiments, pocket handle 220 and/or appearance piece 240 may sit slightly recessed or sub-flush from front 218 of door assembly 180.

Notably, due to manufacturing limitations associated with the construction of conventional handle assemblies, the handle grip on such assemblies was typically very thin. For example, in order to mold the grip of a handle assembly, a large opening must be defined in the back of the pocket recess, e.g., to allow for the removal of a molding tool. In order to conceal this large opening, conventional handle assemblies include a separate support bracket that covers the large opening and is attached to the grip. However, including the support bracket results in several visible seams in the handle assembly which may look or feel undesirable to a user. Notably, due to the unique, multi-piece construction of handle assembly 200, the presence of seams are reduced or eliminated altogether and the rigidity of handle assembly 200 is substantially improved.

Specifically, for example, by molding pocket handle 220 separately from handle frame 202, the thickness and profile of various features on pocket handle 220 may be improved. For example, grip 226 defines a maximum grip thickness 242 measured along the transverse direction T and horizontal arm 222 defines a maximum arm height 244 along a vertical direction V. According to the illustrated embodiment, the grip thickness 242 is greater than three times the arm height 244. According to alternative embodiments, grip thickness 242 may be four, five, or more times greater than arm height 244.

In addition, pocket recess 210 may define a maximum recess depth 246 measured along the transverse direction. According to the illustrated embodiment, this maximum recess depth 246 is defined proximate top wall 214 of handle frame 202. According to the illustrated embodiment, the grip thickness 242 may be greater than approximately one quarter of the recess depth 246. According still other embodiments, grip thickness 242 may be approximately half of recess depth 246, or larger. Notably, being able to manufacture grip 226 having such a large grip thickness 222 provides the user with a handle assembly 200 that feels more substantial, rigid, and high-quality to a user.

Referring still to FIGS. 3 through 9, handle assembly 200 may further include status indication features for providing a user of dishwasher 100 with important information or notifications regarding status of an operating cycle, operating faults, or other information related to dishwasher 100. Although exemplary status indication features are described below with reference to handle assembly 200, it should be appreciated that the status indication features described herein are only exemplary and may vary or be used with another appliance while remaining within scope of the present subject matter.

As shown, handle assembly 200 may further include one or more status indicators 250 which may be fixedly mounted within handle assembly 200. As used herein, "status indicator" may be used to refer to any component of handle assembly 200 which is configured for being illuminated by a light source. For example, according to the illustrated embodiment, status indicator 250 is a light diffuser or a light pipe 252 that extends from within door gap 186 to a front 218 of door assembly 180. Alternatively, status indicator 250 may be any suitable transparent or semitransparent feature for diffusing, directing, or otherwise transmitting light from a light source, as described below according to exemplary embodiments.

According to exemplary embodiments the present subject matter, pocket handle 220 and handle frame 202 are mounted together such that status indicator 250 is positioned between pocket handle 220 and handle frame 202. In this manner, light that is transmitted through status indicator 250 is not directed into pocket recess 210, but is instead directed out of front 218 of door assembly 180. Specifically, pocket handle 220 is designed to block all light transmitted through status indicator 250 from entering pocket recess 210. In this manner, a sharp, distinct band of light may illuminate front 218 of door assembly 180 for improved appearance.

Specifically, according to the illustrated embodiment, pocket handle 220 is positioned proximate a top of pocket recess 210. In this regard, horizontal arm 222 is positioned proximate top wall 214 of handle frame 202. According to an embodiment where no status indicator 250 is present, horizontal arm 222 may directly contact and sit flush with a top wall 214. However, as illustrated, pocket handle 220 and handle frame 202 are spaced apart to define an illumination gap 254.

In this regard, horizontal arm 222 and top wall 214 of handle frame 202 are spaced apart along the vertical direction V to define illumination gap 254. As illustrated, light pipe 252 is positioned between a top surface 256 of pocket handle 220 and a bottom surface of handle frame 202. In this regard, status indicator 250, or more specifically light pipe 252, is positioned within illumination gap 254 for directing light out of front 218 of door assembly 180, e.g., directly along the transverse direction T. Moreover, light transmitted within light pipe 252 is prevented from going around or passing through top surface 256 into pocket recess 210.

Figure 6:
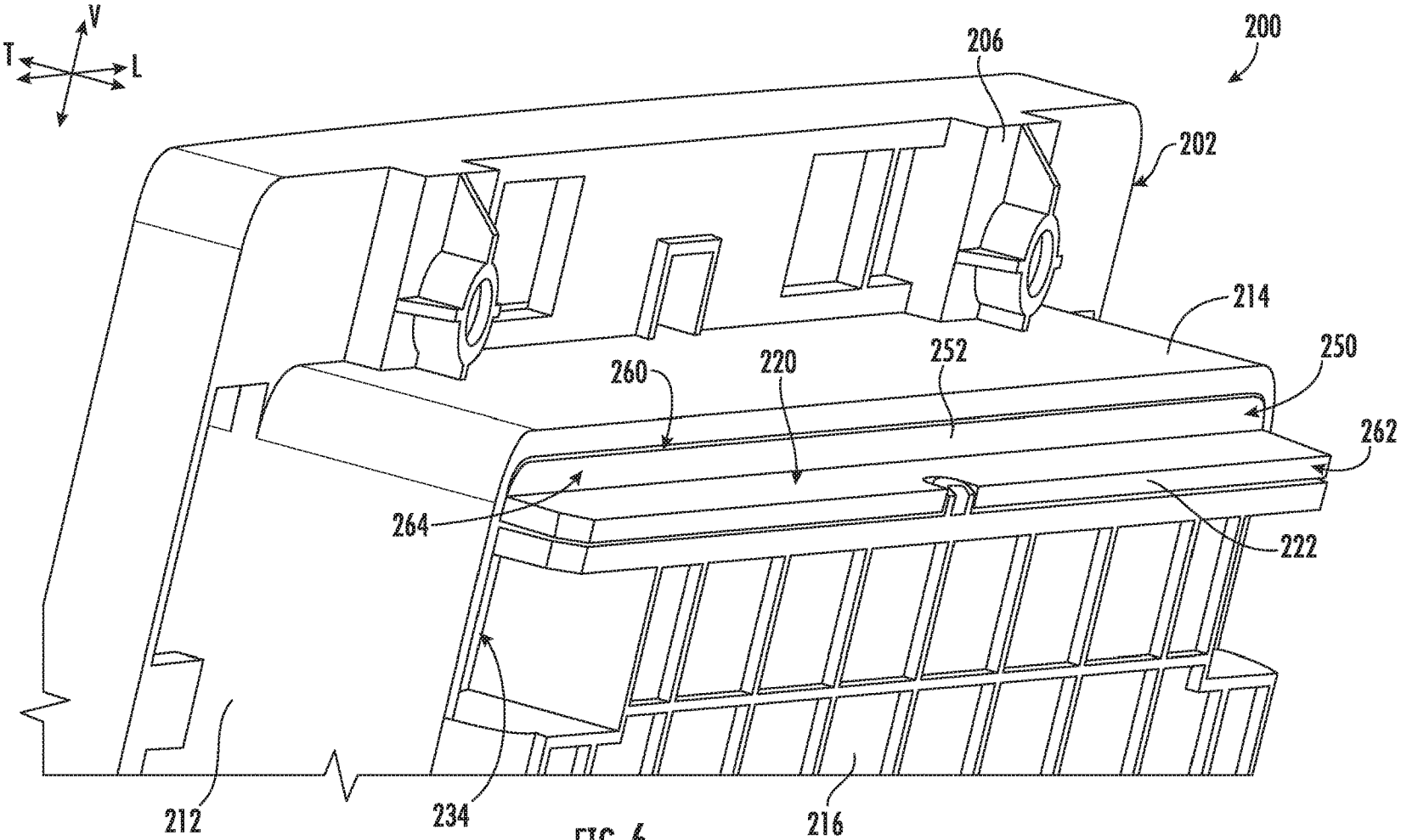
FIG. 6 provides a rear, perspective view of the exemplary handle assembly of FIG. 5 according to an example embodiment of the present subject matter.

As best shown in FIGS. 4, 6, and 8, rear wall 216 of handle frame 202 may define a cutout 260 positioned proximate top wall 214 of handle frame 202. As illustrated, a rear end 262 of horizontal arm 222 may extend into and be received within cutout 260. Furthermore, horizontal arm 222 may extend along the lateral direction L between sidewalls 212. In this manner, horizontal arm 222 completely seals illumination gap 254 relative to the portion of pocket recess 210 below pocket handle 220 to prevent light from being directed into that area.

In addition, top surface 256 of horizontal arm 222 may be slanted relative to the horizontal direction such that illumination gap 254 is tapered toward front 218 of door assembly 180. Thus, light pipe 252 may be tapered toward front surface 218, such that its rear end 264 is thicker than its front end. In this regard, top surface 256 of pocket handle 220 may be angled relative to the transverse direction T for securely receiving tapered light pipe 252 while still fitting tightly against top wall 214. Moreover, light pipe 252 may define an alignment pin 266 that extends into a receiving hole 268 defined within horizontal arm 222 to properly align and position light pipe 252, e.g., such that it sits flush with a front 218 of door assembly 180. In this manner, a large light source may be positioned proximate rear end 264, and tapered light pipe 252 may direct, focus, and intensify the generated light through light pipe 252.

According to the illustrated embodiment, illumination gap 254 is defined proximate a top of pocket recess 210 between horizontal arm 222 and top wall 214 of handle frame 202. However, it should be appreciated that handle assembly 200 may have alternate configurations while remaining within the scope of the present subject matter. For example, handle assembly 200 may be flipped upside down such that grip 226 extends upward from horizontal arm 222 and light pipe 252 is positioned proximate a bottom of pocket recess 210.

Alternatively, status indicator 250 may extend around an entire perimeter of pocket recess 210. According to such an embodiment, pocket handle 220 would also extend around the entire perimeter of pocket recess 210 and would be spaced apart from handle frame 202 (e.g. sidewalls 212, top wall 214, and rear wall 216) to define a continuous illumination gap 254. Other configurations are possible and within the scope of the present subject matter.

Referring again generally to FIGS. 3 and 4, door assembly 180 may further include a lighting assembly 280 that is positioned within door gap 186 and is generally configured for illuminating status indicators 250, such as light pipe 252. Notably, lighting assembly 280 is generally mounted on inner door 182 and is electrically coupled to main control board 194 by a wiring harness 282. In this manner, wiring harness 282 may be a short and relatively inexpensive harness that is connected to lighting assembly 280 prior to installing outer door 184 during the assembly of door assembly 180. By contrast, if lighting assembly 280 were mounted on outer door 184, a much longer and costly wiring harness would be needed, particularly when outer door 184 slides onto inner door 182 as described herein.

Specifically, lighting assembly 280 includes a mounting bracket 284 which is mounted to inner door 182 using any suitable mechanical fasteners (such as fasteners 208 as shown in FIG. 3). Thus, mounting bracket 284 has a fixed vertical position relative to inner door 182. Lighting assembly 280 further includes a board assembly 286 which includes at least one light source 288 for illuminating status indicator 250. For example, according to the illustrated embodiment, board assembly 286 includes a printed circuit board and a light source 288 includes a plurality of light emitting diodes (LEDs). However, it should be appreciated that according to alternative embodiments, any other suitable mounting board may be used for light source 288 which may include any other suitable traditional light bulbs or sources, such as halogen bulbs, incandescent bulbs, glow bars, a fiber light source, etc.

Notably, it is often desirable to properly line up light source 288 with light pipe 252 or status indicator 250 to achieve consistent brightness, intensity, and uniformity. However, because lighting assembly 280 is mounted on inner door 182 and status indicator 250 is mounted on outer door 184, features for ensuring proper alignment are desirable. In this regard, lighting assembly 280 may further include a biasing assembly 290 that operably couples board assembly 286 to mounting bracket 284. More specifically, biasing assembly 290 is configured for urging board assembly 286 against a feature fixed to outer door 184 to align light source 288 with status indicator 250.

Referring again to FIGS. 3 and 4, biasing assembly 290 may include one or more posts 292 that extend from mounting bracket 284 toward board assembly 286. Board assembly 286 may define apertures (not shown) through which posts 292 may pass such that board assembly 286 is slidably mounted on posts 292. In addition, biasing assembly 290 may include one or more spring elements 294 that are positioned between mounting bracket 284 and board assembly 286 to urge support assembly 286 away from mounting bracket 284. Specifically, according to the illustrated embodiment, posts 292 and spring elements 294 extend substantially along the vertical direction V to urge board assembly 286 downward relative to inner door 182. It should be appreciated that as used herein, terms of approximation, such as "approximately," "substantially," or "about," refer to being within a ten percent margin of error.

In addition, biasing assembly 290 may include a retention fastener 296 that is attached to a distal end of the each post 292. Retention fastener 296 may include a larger head than the apertures defined in board assembly 286, thereby preventing board assembly 286 from sliding off posts 292. In addition according to the illustrated embodiment, spring elements 294 are wrapped around posts 292 to ensure proper alignment and movement of board assembly 286. According to alternative embodiments, handle assembly 200 may include one or more alignment features (not shown) which may contact board assembly 286, light sources 288, or any other part with a fixed relationship relative to light sources 288 to properly align light sources 288 with light pipe 252.

Although biasing assembly 290 is described above as being a spring assembly using mechanical springs 294 mounted on alignment posts 292, it should be appreciated that any suitable device or mechanism for urging board assembly 286 or light source 288 into alignment with light pipe 252 may be used according to alternative embodiments. For example, biasing assembly 290 may be a collapsible or resilient foam, a mechanical actuator, a hydraulic system, or any other assembly that is configured for aligning light source 288 and light pipe 252 for proper illumination.

It should be appreciated that although dishwashing appliance 100 is used to describe door assembly 180, handle assembly 200, and lighting assembly 280 above, aspects of the present subject matter may be used for any other suitable appliance. For example, the present subject matter may be used in other dishwasher appliances, refrigerators, microwaves, ovens, and any other door assembly which includes status indicators that are illuminated by one or more light sources. In addition, modifications and variations may be made to the exemplary embodiments described herein while remaining within the scope of the present subject matter.

Now that the construction and configuration of dishwasher appliance 100 and an associated door assembly 180 have been described according to an exemplary embodiment of the present subject matter, an exemplary method 300 for manufacturing a handle assembly for an appliance door will be described according to an exemplary embodiment of the present subject matter. Method 300 can be used to make handle assembly 200 for dishwasher appliance 100 or any other suitable handle assembly for any other appliance. It should be appreciated that the exemplary method 300 is discussed herein only to describe exemplary aspects of the present subject matter, and is not intended to be limiting.

Figure 10:
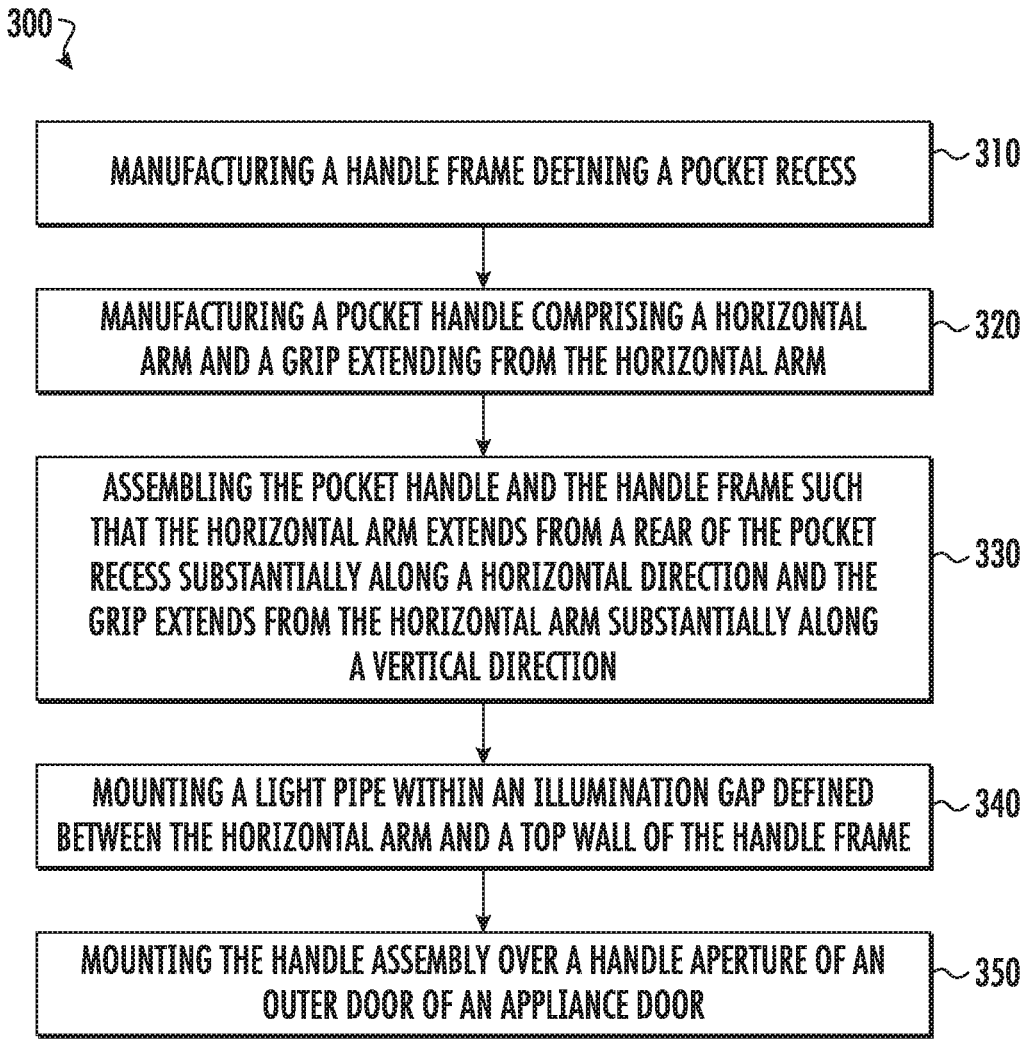
FIG. 10 is a method of manufacturing a handle assembly for an appliance door according to an example embodiment of the present subject matter.

Referring now to FIG. 10, method 300 includes, at step 310, manufacturing a handle frame defining a pocket recess. For example, continuing the example from above, handle frame 202 may be injection molded from plastic or another suitably rigid material to define pocket recess 210. Step 320 includes manufacturing a pocket handle comprising a horizontal arm and a grip extending from the horizontal arm. Thus, step 320 may include injection molding pocket handle 220 as described above.

Step 330 includes assembling the pocket handle and the handle frame such that the horizontal arm extends from a rear of the pocket recess substantially along the horizontal direction and the grip extends from the horizontal arm substantially along the vertical direction. As described above, for example, pocket handle 220 and handle frame 202 may be secured together using any suitable mechanical fastener, e.g., such as mechanical fastener 208. In addition, by manufacturing these two components separately and assembling them after the fact, desirable geometries may be formed from each and support structures that would be otherwise be needed may be eliminated.

Step 340 includes mounting a light pipe within an illumination gap defined between the horizontal arm of the pocket handle and a top wall of the handle frame. In this manner, a lighting assembly may be mounted behind the light pipe, e.g. within a door gap and may direct light out a front of the appliance door and not into the pocket recess. In this manner, a sharp illuminated line may be defined around the pocket handle to provide status indication to a user without any light bleeding into pocket recess. It should be appreciated that the light pipe may be attached first to the pocket handle before mounting to the handle frame or may be separately attached to the handle frame before installing the pocket handle. Step 300 may further include, at step 350, mounting the handle assembly over a panel aperture of an outer door of an appliance door. In this regard, for example, mounting brackets of handle assembly may be screwed to an outer door of a dishwasher.

FIG. 10 depicts an exemplary method having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using dishwasher 100 as an example, it should be appreciated that these methods may be used to manufacture a handle assembly for any other suitable appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A handle assembly for an appliance door, the appliance door comprising an outer door and an inner door spaced apart by a door gap, the outer door defining a handle aperture, the handle assembly comprising:

a handle frame mounted to the outer door over the handle aperture, the handle frame defining a pocket recess positioned within the door gap;

a pocket handle mounted to the handle frame within the pocket recess, the pocket handle comprising:

a horizontal arm extending from a rear of the pocket recess toward a front of the appliance door substantially along a horizontal direction; and a grip extending from the horizontal arm substantially along a vertical direction, wherein a front surface of the grip sits flush with a front of the outer door.

2. The handle assembly of claim 1, wherein the horizontal arm is positioned proximate a top wall of the handle frame.

3. The handle assembly of claim 2, wherein the horizontal arm and the top wall of the handle frame are spaced apart along a vertical direction to define an illumination gap.

4. The handle assembly of claim 3, wherein a light pipe is positioned within the illumination gap.

5. The handle assembly of claim 3, wherein a top surface of the horizontal arm is slanted relative to the horizontal direction such that the illumination gap is tapered toward the front of the appliance door.

6. The handle assembly of claim 1, wherein the handle frame comprises a rear wall defining a cutout proximate a top wall of the handle frame, a rear end of the horizontal arm being received within the cutout.

7. The handle assembly of claim 1, wherein the grip defines a maximum grip thickness along the transverse direction and the horizontal arm defines a maximum arm height along a vertical direction, wherein the grip thickness is greater than three times the arm height.

8. The handle assembly of claim 7, wherein the pocket recess defines a maximum recess depth measured along the transverse direction, the grip thickness being greater than approximately one-quarter of the recess depth.

9. The handle assembly of claim 1, wherein the pocket handle and the handle frame are separate parts joined together with one or more mechanical fasteners.

10. The handle assembly of claim 1, wherein the pocket handle further comprises:

one or more screw bosses defined on a rear side of the grip for receiving one or more mechanical fasteners passed through the handle frame.

11. The handle assembly of claim 1, wherein the appliance door is a dishwasher door.

12. A method of manufacturing a handle assembly for an appliance door, the method comprising:

manufacturing a handle frame defining a pocket recess;

manufacturing a pocket handle comprising a horizontal arm and a grip extending from the horizontal arm; and assembling the pocket handle and the handle frame such that the horizontal arm extends from a rear of the pocket recess substantially along a horizontal direction and the grip extends from the horizontal arm substantially along the vertical direction, wherein a front surface of the grip sits flush with a front of the appliance door.

13. The method of claim 12, comprising:

mounting the handle assembly over a handle aperture of an outer door of the appliance door.

14. The method of claim 12, wherein the horizontal arm and a top wall of the handle frame are spaced apart along a vertical direction to define an illumination gap, the method further comprising:

mounting a light pipe within the illumination gap.

15. The method of claim 14, wherein a top surface of the horizontal arm is slanted relative to the horizontal direction such that the illumination gap is tapered toward the front of the appliance door.

16. The method of claim 12, wherein the grip defines a maximum grip thickness along the transverse direction and the horizontal arm defines a maximum arm height along a vertical direction, wherein the grip thickness is greater than three times the arm height.

17. The method of claim 12, wherein the pocket handle and the handle frame are separate parts and assembly the pocket handle and the handle frame comprises:

attaching the pocket handle to the handle frame using one or more mechanical fasteners.

18. A handle assembly for an appliance door, the appliance door comprising an outer door and an inner door spaced apart by a door gap, the outer door defining a handle aperture, the handle assembly comprising:

a handle frame mounted to the outer door over the handle aperture, the handle frame defining a pocket recess positioned within the door gap;

a pocket handle mounted to the handle frame within the pocket recess, the pocket handle comprising:

a horizontal arm extending from a rear of the pocket recess toward a front of the appliance door substantially along a horizontal direction; and a grip extending from the horizontal arm substantially along a vertical direction; and an appearance piece mounted to a front surface of the grip, wherein the appearance piece sits flush with a front of the outer door.

* * * * *